United States Patent [19]

Berkus

[11] 4,363,182

[45] Dec. 14, 1982

[54] MOUNTING BRACKET FOR PEDESTRIAN CROSSING SWITCH AND SIGN

[75] Inventor: Clyde C. Berkus, Van Nuys, Calif.

[73] Assignee: Building Components, Inc., Van Nuys, Calif.

[21] Appl. No.: 271,417

[22] Filed: Jun. 8, 1981

[51] Int. Cl.[3] ..... G09F 15/00

[52] U.S. Cl. ..... 40/607; 40/10 R

[58] Field of Search ..... 40/10 R, 606, 607

[56] References Cited

U.S. PATENT DOCUMENTS

| | | | |
|---|---|---|---|
| 1,581,981 | 4/1926 | Phelps | 40/10 R |
| 1,723,472 | 8/1929 | Elsey | 40/10 R |
| 1,788,232 | 1/1931 | Davis | 40/607 |
| 2,759,281 | 8/1956 | Akers | 40/607 |
| 4,187,418 | 2/1980 | Harris | 40/606 |

*Primary Examiner*—Paul J. Hirsch
*Assistant Examiner*—Wenceslao J. Contreras
*Attorney, Agent, or Firm*—Keith D. Beecher

[57] ABSTRACT

A plastic bracket assembly is provided for mounting a pedestrian crossing switch and sign on a pole. The assembly includes a plastic frame which circumscribes an open front of the assembly for receiving the sign, and a switch housing mounted on the frame adjacent to the sign. The bracket assembly is adaptable to fit a number of different sized poles merely by changing a top member which is removably mounted on the frame. The sign is formed of clear plastic, with indicia on its back visible through the plastic. The sign is held in place by the top member, and side tabs which are formed integral with the frame. Accordingly, no screws are required for mounting the sign. The bracket is mounted on the pole by two screws which extend through bushings formed in a strap which is integral with the frame, and which extends across the open front of the frame behind the sign.

3 Claims, 5 Drawing Figures

TO CROSS STREET
PUSH BUTTON WAIT FOR
WALK
SIGNAL
10
12
14
16
18
22
26
30
2
3
4

MOUNTING BRACKET FOR PEDESTRIAN CROSSING SWITCH AND SIGN

BACKGROUND

For many years brackets for mounting pedestrian crossing signal switches and signs on poles have been formed of metal castings. The metal castings are configured to define a rectangular frame, and also to form a housing for the switch adjacent to the frame. The sign itself in the prior art assembly is made of metal with indicia stencilled, or otherwise formed on its front surface. Such a sign, however, is susceptible to corrosion, and it requires painting which is easily scratched. The prior art metal sign, moreover, is susceptible to vandalism in that it can be easily removed merely by removing the screws. Also, the prior art bracket assembly is adapted to fit only one sized pole conveniently.

The plastic bracket of the present invention may be formed of polycarbonate or polyvinylchloride (PVC), or other suitable plastic material, and it and its sign are constructed in a manner described briefly above to overcome the disadvantages of the prior art bracket, and to provide a simple, inexpensive and rugged assembly for the intended purpose, which requires minimal maintenance, and which is not susceptible to vandalism. The bracket of the invention may be fitted on a number of different sized poles, merely by selecting the proper top for a standard sized body, so that only the tops need be made in different sizes.

DETAILED DESCRIPTION OF THE ILLUSTRATED EMBODIMENT

Figures 1, 2, 3:
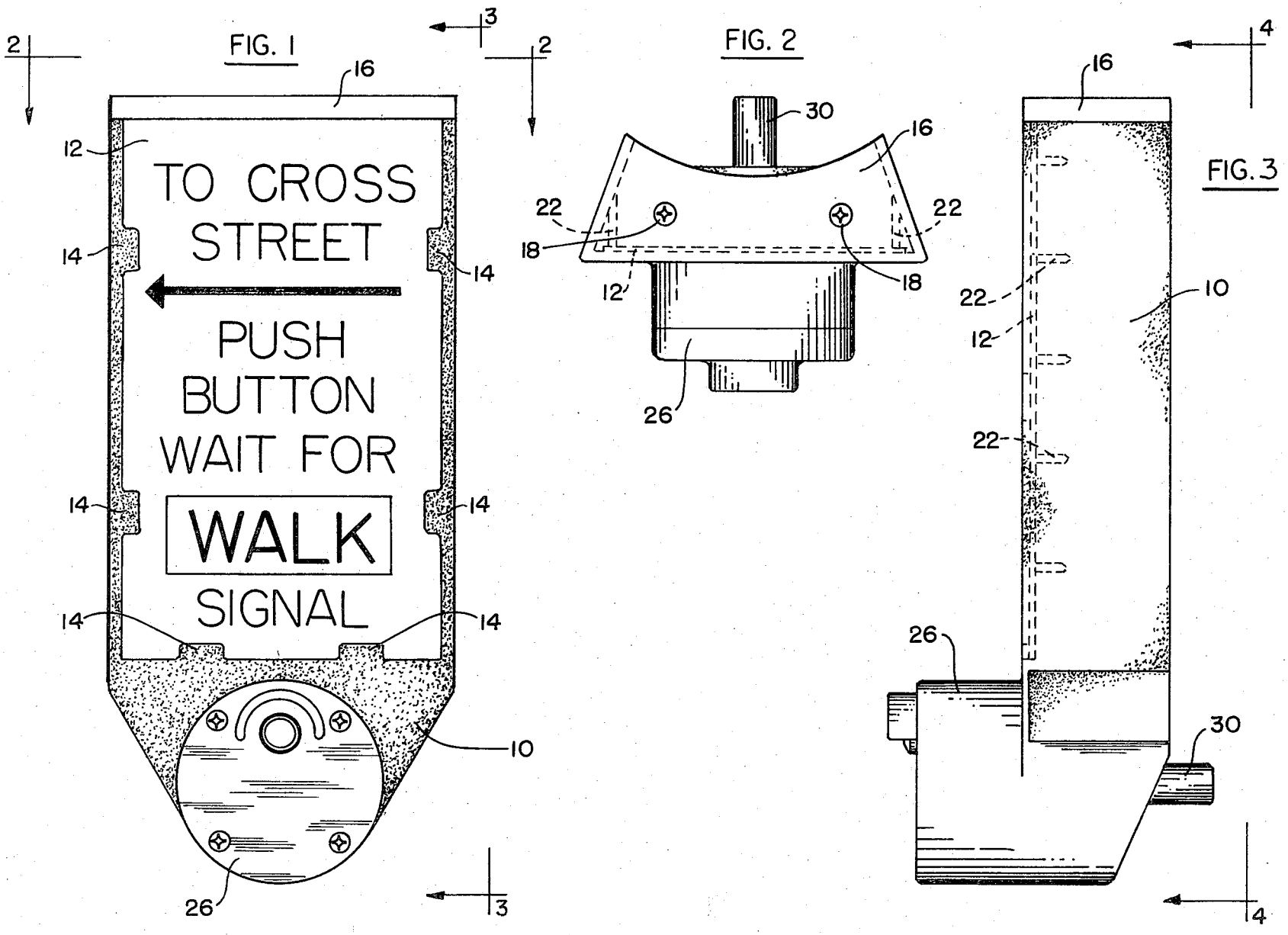
FIG. 1 is a front elevational view of a bracket assembly constructed in accordance with the present invention.
FIG. 2 is a top plan view of the assembly taken essentially along the line 2—2 of FIG. 1.
FIG. 3 is a side elevational view taken essentially along the line 3—3 of FIG. 1.

The bracket assembly of the invention may be formed of a frame member 10 composed, for example, of polycarbonate, or other appropriate plastic material. The frame 10 defines an open front of a rectangular configuration, and a sign 12 is mounted on the frame, and extends across the open front. The sign 12 is held in place by integral tabs 14 formed on the frame, and by the rim of a top member 16. The top member 16, as best shown in FIG. 2, is mounted on the top of the frame 10 by screws 18, and it can be removed and replaced by other top members. Top member 16 has a rear side with an arcuate configuration which is adapted to conform with the arcuate configuration of the pole on which the bracket assembly is mounted. As stated above, the top member 16 can be removed, and replaced by other top members, for different sized poles.

Figure 4:
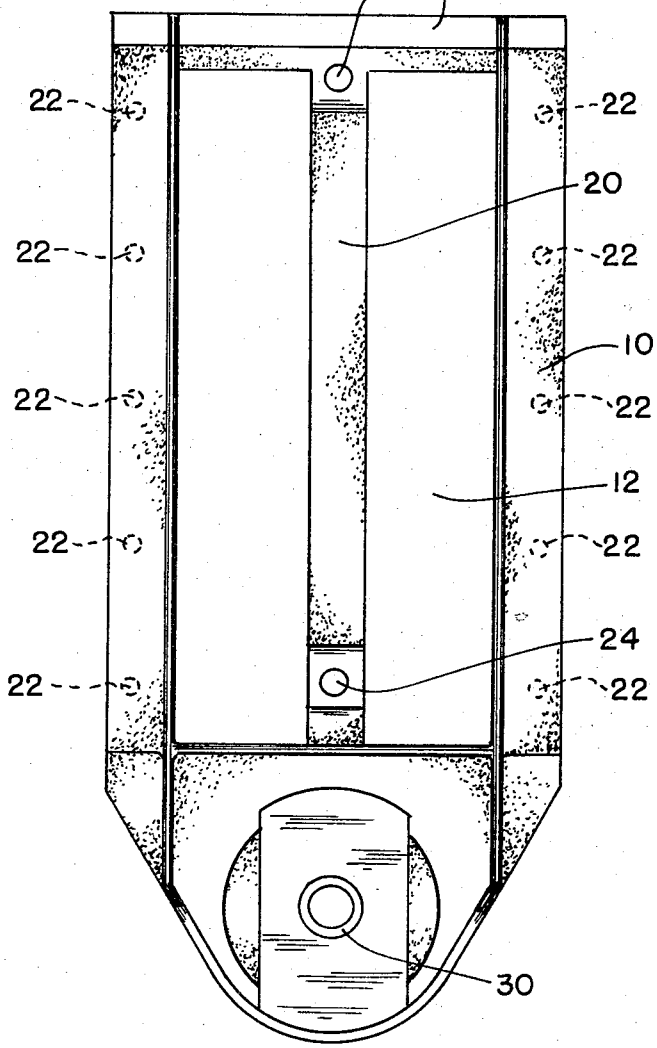
FIG. 4 is a rear view taken along the line 4—4 of FIG. 3.

As shown in FIG. 4, a vertical strip 20 is formed integral with frame 10, and it extends vertically across the open front of the frame to the rear of the sign 12, to support the sign in the frame.

A further plurality of tabs 22 are formed integral with the frame and extend inwardly from the frame to the rear of sign 12 further to assist in supporting the sign in the frame.

A pair of bushings 24 are formed integral with the strip 20, and the bushings receive screws for mounting the assembly on the pole. Additional bushings may be provided to back up bushings 24 when the diameter of the pole is such that bushings 24 are spaced from the surface of the pole.

A housing 26 is mounted on the frame 10 directly under the sign, and any appropriate manually operated crossing switch may be mounted within the switch housing. The housing also defines a rearwardly extending tubular member 30 which extends into a hole in the pole, and which receives the electric wires which are connected to the switch.

Figure 5:
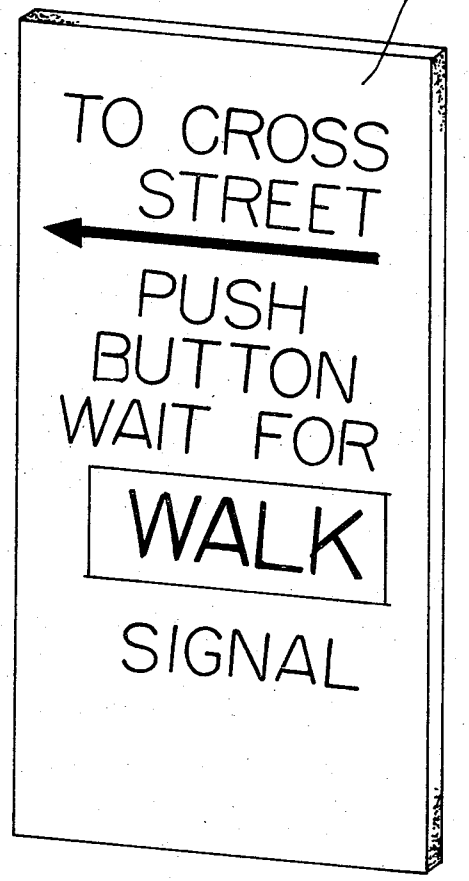
FIG. 5 is a perspective representation of the sign which is supported in the bracket assembly of FIG. 1.

The sign 12, as shown in FIG. 5, may be formed of any appropriate transparent plastic material, such as a polycarbonate plastic. The lettering of the sign is preferably formed on the back surface, so that it cannot be scratched off, and is visible through the transparent plastic material. The lettering, for example, may be formed in black, and covered by a white coating on the rear side of the sign, so as to be readily visible.

The bracket assembly may be easily mounted on the pole, merely by removing the top member 16, and the sign 12. Appropriate screws are then inserted through bushings 24 to mount the sign on the pole, with the tubular member 30 extending into a hole in the pole, as explained above.

The sign 12 is then slipped down in place in the frame 10 between the tabs 14 and the rear strip 20. The top member 16 is then mounted in place, and it has a rim extending across its front edge which receives the upper edge of sign 12. The upper member is locked in place by screws 18, and serves firmly to retain the sign in the frame 10.

It will be appreciated that although a particular embodiment of the invention has been shown and described, modifications may be made, and it is intended in the claims to cover all modifications which come within the true spirit and scope of the invention.

What is claimed is:

1. A plastic bracket assembly for mounting a pedestrian crossing switch and accompanying sign on a pole, said assembly including: a frame formed of plastic material and having side members defining an open top; a top member removably secured to said frame, said top member having an arcuately-shaped rear side conforming with the arcuate shape of the pole on which the bracket assembly is mounted; a sign enclosing said open front; a plurality of inwardly extending tabs formed integral with said frame at predetermined locations adjacent to the sides of the open front and said top member having a rim extending across the top of said open front, both said tabs and said rim serving to retain the sign in the frame; a strip member integral with the frame and extending across the frame, said strip member having holes therein for receiving screws for mounting the bracket assembly on the pole; and a switch housing mounted on said frame adjacent to said open front.

2. The bracket assembly defined in claim 1, in which said strip member is formed integral with said frame and extends from the bottom to the top of the open front thereof to form a rear support for the sign.

3. The bracket assembly defined in claim 1, in which said sign is formed of transparent plastic material having indicia formed on the rear side thereof to be visible through the transparent plastic material.

* * * * *